US011243498B2

(12) United States Patent
Kwiecinski et al.

(10) Patent No.: US 11,243,498 B2
(45) Date of Patent: Feb. 8, 2022

(54) CONTROL CROWN FOR A TIMEPIECE

(71) Applicant: The Swatch Group Research and Development Ltd, Marin (CH)

(72) Inventors: Karol Kwiecinski, Courrendlin (CH); Gilles Vuilleumier, Bienne (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 16/988,779

(22) Filed: Aug. 10, 2020

(65) Prior Publication Data

US 2021/0157276 A1 May 27, 2021

(30) Foreign Application Priority Data

Nov. 21, 2019 (EP) ..... 19210665

(51) Int. Cl.
*G04B 37/10* (2006.01)
*G04B 3/04* (2006.01)

(52) U.S. Cl.
CPC ..... *G04B 37/10* (2013.01); *G04B 3/041* (2013.01)

(58) Field of Classification Search
CPC ..... G04F 7/08; G04B 3/041; G04B 37/10; G04B 37/103; G04B 37/106; G04B 3/043; G04B 3/046; G04B 37/04; G04B 37/066
USPC ..... 368/308
See application file for complete search history.

(56) References Cited

U.S. PATENT DOCUMENTS

| | | | | |
|---|---|---|---|---|
| 6,018,503 | A | 1/2000 | Pfister et al. | |
| 8,282,271 | B2 * | 10/2012 | Kressmann | G04B 37/066 368/319 |
| 10,613,481 | B2 * | 4/2020 | Iguchi | G04B 3/046 |
| 2006/0184159 | A1 | 8/2006 | Lambert | |
| 2011/0013496 | A1 | 1/2011 | Kressmann et al. | |
| 2011/0216631 | A1 | 9/2011 | Pittet | |
| 2013/0100782 | A1 | 4/2013 | Cattaneo et al. | |

FOREIGN PATENT DOCUMENTS

| | | |
|---|---|---|
| CH | 695 470 A5 | 5/2006 |
| CH | 711 600 A1 | 4/2017 |
| CH | 711 600 B1 | 4/2017 |
| CH | 711600 A1 | 4/2017 |
| CN | 1904770 A | 1/2007 |

(Continued)

OTHER PUBLICATIONS

European Search Report dated May 26, 2020 in European Application 19210665.6 filed Nov. 21, 2019 (with English Translation of Categories of Cited Documents), 3 pages.

*Primary Examiner* — Edwin A. Leon
(74) *Attorney, Agent, or Firm* — Oblon, McClelland, Maier & Neustadt, L.L.P.

(57) ABSTRACT

A control crown for a timepiece, capable of cooperating, in order to maneuver a control rod, with a middle including a recess along an axis receiving a tube included in the crown, which includes a crown body capable of rotating covering both the rod and the tube, which includes a hollow to allow the rod to pass and/or be guided in rotation, the crown includes a closing cap fastened to the tube in a fixed angular position relative to the middle by the cooperation between indexing device of the tube and complementary indexing device of the closing cap, to axially enclose the crown body between the middle and the closing cap.

11 Claims, 3 Drawing Sheets

(56) References Cited

FOREIGN PATENT DOCUMENTS

| | | | |
|---|---|---|---|
| CN | 101416125 | A | 4/2009 |
| CN | 101576755 | A | 11/2009 |
| CN | 102971679 | A | 3/2013 |
| CN | 105547146 | A | 5/2016 |
| CN | 105929668 | A | 9/2016 |
| EP | 2 275 883 | A1 | 1/2011 |
| EP | 2 385 432 | A2 | 11/2011 |
| FR | 2596884 | A3 | 10/1987 |
| GB | 528643 | A | 11/1940 |
| JP | 2013-134256 | A | 7/2013 |
| JP | 2019-144228 | A | 8/2019 |

* cited by examiner

CONTROL CROWN FOR A TIMEPIECE

CROSS-REFERENCE TO RELATED APPLICATION

This application claims priority to European Patent Application No. 19210665.6 filed on Nov. 21, 2019, the entire disclosure of which is hereby incorporated herein by reference.

FIELD OF THE INVENTION

The invention relates to a control crown for a timepiece, capable of cooperating with a middle for manoeuvring a control rod belonging to said control crown, said middle comprising at least one main recess along a main axis for receiving a tube comprised in said control crown, which comprises a crown body capable of being mounted such that it rotates about said main axis and arranged so as to be handled by a user to manoeuvre said control rod, and said crown body covering both said tube and said control rod.

The invention relates to a timepiece case comprising such a middle, and at least one such control crown.

The invention relates to a timepiece, in particular a watch, comprising such a case and/or at least one such control crown.

The invention relates to the field of control mechanisms for timepieces.

BACKGROUND OF THE INVENTION

Timepieces often comprise components supporting technical indications, such as graduated sectors or supporting elements identifying the product such as a logo, name or similar element, and can further comprise external components which must be assembled in a specific orientation so as to neither inconvenience nor injure the user.

Carrying out the indexation of such components must guarantee the functionalities and in particular the waterproof seals required. These components are often screwed, which requires creating additional mechanisms to ensure the correct orientation thereof: these mechanisms result in an increased number of components and additional production costs.

Patent document CH711600A1 filed by OFFICINE PANERAI describes a push-piece crown comprising a crown provided with a central extension capable of being connected to a winding stem of a horological movement and a push-piece capable of undergoing axial displacement relative to the crown against an elastic action, this push-piece crown further comprising a tube capable of passing through the wall of a watch case and of being fastened thereto, on which the crown is pivoted. This crown comprises a locking device preventing the actuation of the push-piece unless the crown is placed in at least one predetermined angular position relative to the tube.

Patent document EP2385432A2 filed by ROLEX describes a watch case comprising a middle, a tube provided with a thread, integral with the middle, and a control crown provided with a thread capable of being screwed onto the thread of the tube. The control crown comprises an external part that has a distinctive mark that is visible from the outside and an internal part housed inside the external part and provided with the thread capable of being screwed onto the thread of the tube, one of said parts comprising means for connection to a control stem, in particular to a winding stem, and clamping means for holding the external part and the internal part in an angular position determined with respect to the longitudinal axis of the tube. The internal part comprises first angular indexing means, and the external part comprises second angular indexing means, these indexing means being shaped so as to engage axially in one another by relative axial displacement between the internal part and the external part, the engagement between these indexing means being maintained by said clamping means.

Patent document EP2275883A1 filed by ROLEX describes a timepiece comprising a case enclosing a horological movement, and a transmission mechanism for transmitting constant-velocity rotary movements between two stems on substantially parallel axes, connecting the outside of the case to the horological movement through a hole in the case. The adjacent ends of these two stems are rigidly connected to two respective sliding elements having defined cross sections engaged with two respective slide-ways having cross sections complementary to those of said sliding elements, having sliding planes perpendicular to said axes, the two slide-ways being rigidly connected to a common linking member and being oriented at an angle of 90° to each other.

SUMMARY OF THE INVENTION

The invention proposes producing an indexed component, the indexing whereof remains constant, at a low cost and with the lowest possible number of components. Moreover, the invention more particularly relates to a crown for a timepiece, in particular for a watch.

Thus, the invention relates to a control crown according to claim 1.

The invention further relates to a timepiece case equipped with at least one such crown.

The invention further relates to a timepiece, in particular a watch, comprising such a case, and/or at least one such crown.

BRIEF DESCRIPTION OF THE DRAWINGS

Other features and advantages of the invention will be better understood upon reading the following detailed description given with reference to the accompanying drawings, in which:

FIG. 6 shows the insertion and fastening of a tube inside a recess in the middle, provided for this purpose; this tube comprises a hollow intended to receive a control rod, in this case in an off-centred manner relative to the fastening face of the tube; this tube comprises, at the end thereof opposite the middle, indexing means formed, in this particular case, by two bores;

FIG. 7 shows the insertion of a crown body onto this tube, and bearing against the middle; this crown body comprises, on the middle side, an inner flange, and it then comprises, moving away from the middle, an inner spline or toothing, followed by a tapping, then a counterbore at the end opposite the middle;

FIG. 8 shows the insertion of a control rod between the crown body and the tube, and this rod comprises, on the middle side, a guiding face visible in FIG. 1, which is inserted into a bore passing through the middle, also visible in FIG. 1, and it then comprises an outer spline or respectively toothing, which meshes with the inner spline or toothing of the crown body; on the side opposite the middle, this rod comprises a substantially planar bearing surface, perpendicular to the axis thereof;

FIG. 9 shows the screwing of a nut into the crown body, allowing the end of the tube opposite the middle to pass, and such that it limits the axial travel of the control rod contained therein;

FIG. 10 shows the fastening of a closing cap on the tube, in an imposed angular position;

DETAILED DESCRIPTION OF THE PREFERRED EMBODIMENTS

Figure 1:
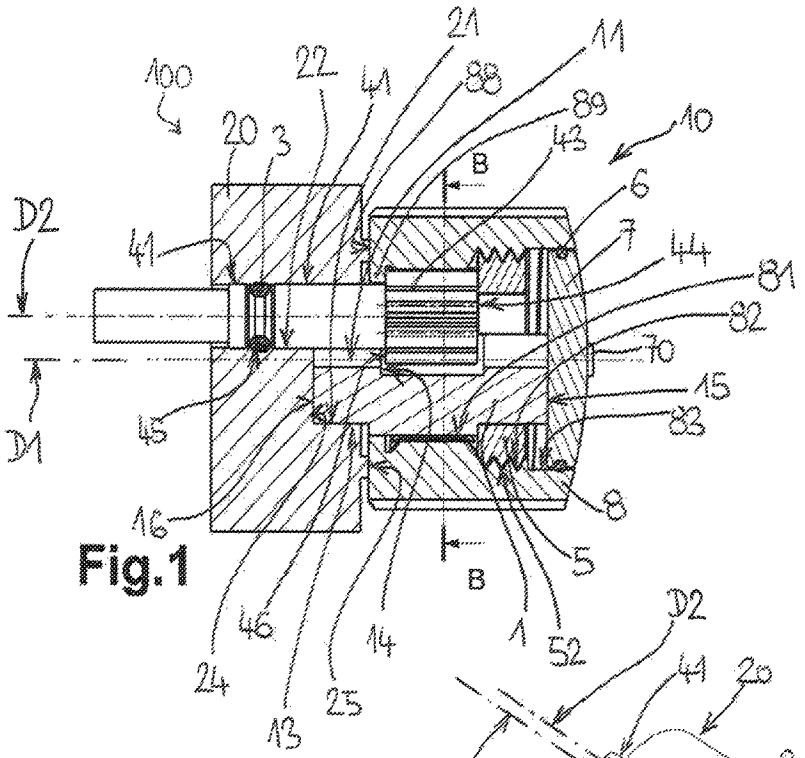
FIG. 1 diagrammatically shows a longitudinal sectional view of a part of an assembly formed by a watch middle and by a control crown according to the invention.
Figure 2:
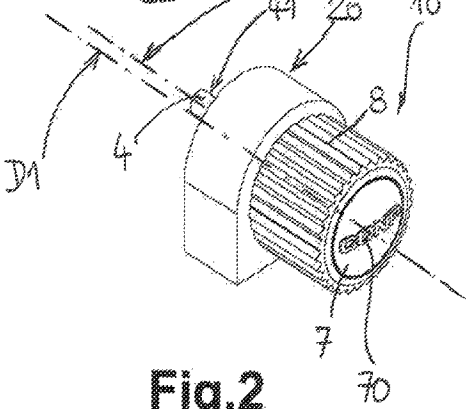
FIG. 2 diagrammatically shows a perspective view of the assembly in FIG. 1, the crown whereof supports an end-closing cap bearing a logo.
Figure 3:
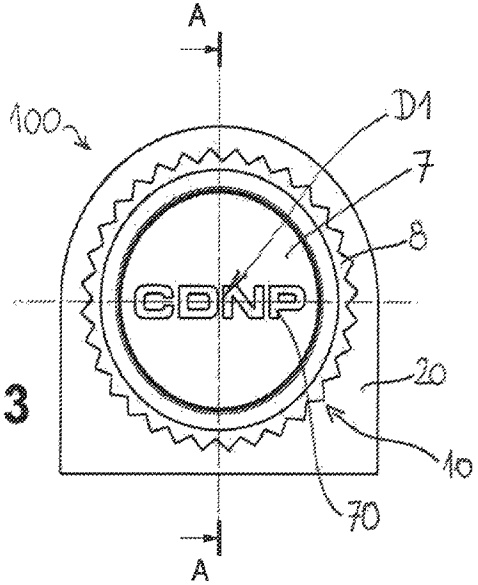
FIG. 3 shows an end view of the assembly in FIG. 1.
Figure 4:
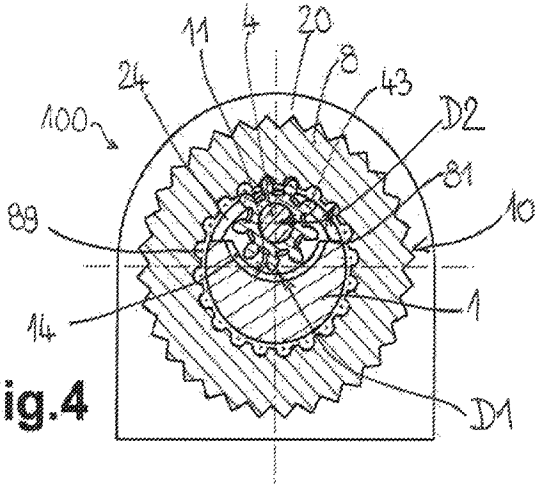
FIG. 4 diagrammatically shows a cross-sectional view, perpendicular to the crown axis, of the assembly in FIG. 1.
Figure 5:
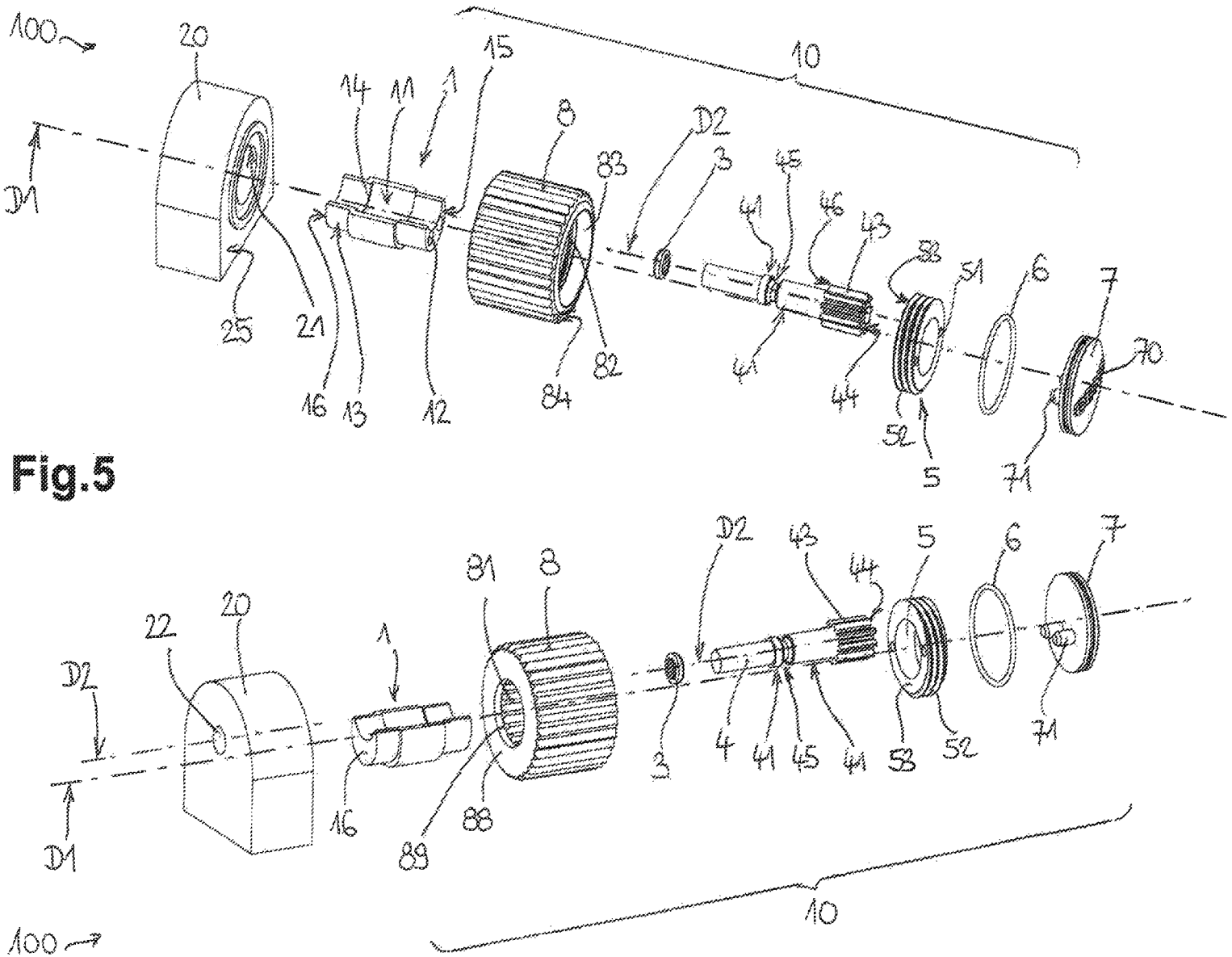
FIG. 5 shows an exploded perspective view, from two different angles, of the components of the assembly in FIG. 1.

The invention relates to a control crown 10 for a timepiece 1000. This crown 10 is capable of cooperating with a middle 20, comprised in a case 100 of the timepiece 1000, or comprised in the timepiece 1000, for manoeuvring a control rod 4 belonging to the control crown 10.

The middle 20 conventionally comprises at least one main recess 21, along a main axis D1, for receiving a tube 1 comprised in the control crown 10. The crown 10 comprises a crown body 8, which is capable of being mounted such that it rotates about the main axis D1, and is arranged so as to be handled by a user to manoeuvre the control rod 4, for example to control a hand-setting, winding, start timer, resetting, sound alarm, time zone setting, or other function.

The crown body 8 covers both the tube 1 and the control rod 4.

According to the invention, the tube 1 comprises a hollow 11, which is provided to allow the control rod 4 to pass and/or be guided in rotation about an axis D2 parallel to the main axis D1. Moreover, the control crown 10 comprises a closing cap 7, which is arranged so as to be fastened to the tube 1 in a fixed angular position relative to the middle 20, by cooperation between the indexing means 12, such as bores, or shaped recesses, comprised in the tube 1, and complementary indexing means 71 comprised in the closing cap 7, such as cylindrical lugs or respectively shaped fingers. The fastening of this closing cap 7 thus allows the crown body 8 to be axially enclosed between the middle 20 and the closing cap 7.

In one specific alternative embodiment shown in the figures, the hollow 11 is off-centred to allow the control rod 4 to pass and/or be guided in rotation about a secondary axis D2 parallel to the main axis D1 and separate therefrom.

More particularly, the crown body 8 comprises a counterbore 83 which is capable of receiving a gasket 6 beneath the closing cap 7.

More particularly, the crown body 8 comprises an inner toothing or spline 81, which is arranged so as to cooperate with an outer toothing or respectively spline 43 comprised in the control rod 4, to drive the control rod 4 in rotation.

More particularly, the crown body 8 comprises a tapping 82, which is capable of cooperating in a complementary manner with a threading 52 of a nut 5 inserted between the control rod 4 and the closing cap 7. This nut 5 comprises a frontal bearing surface 53, which is arranged so as to form an abutment axial to a complementary frontal bearing surface 44 comprised in the control rod 4, on the side opposite the middle 20. The nut 5 comprises manoeuvring means 51 for being grasped by a suitable tool.

More particularly, the crown body 8 is capable of moving between the middle 20 and the closing cap 7 with limited axial travel, and the crown body 8 comprises a flange 89, which constitutes a means for axially stopping the control rod 4 on the middle 20 side. Thus, the travel of the control rod 4 is limited on one side by the flange 89 of the crown body 8, and on the other side by the frontal bearing surface 53 of the nut 5. The flange 89 allows the control rod 4 to be pulled, for example to change its position T0/T1/T2, when the crown body 8 has an axial travel.

In an alternative embodiment not shown, the crown body 8 is returned towards the middle 20 by an elastic return means biased to press same against the middle 20.

In another alternative embodiment not shown, the crown body 8 is moved away from the middle 20 by another elastic return means.

In yet another alternative embodiment, the inner toothing or spline 81 comprised in the crown body 8, and arranged so as to drive the control rod 4 in rotation, is only engaged with the control rod 4 over a part of the axial travel of the control rod 4.

The invention further relates to a timepiece case 100 comprising a middle 20 comprising at least one main recess 21 extending along a main axis D1 for receiving a control crown tube, and at least one such control crown 10 comprising a tube 1 capable of being inserted into this at least one main recess 21.

More particularly, the middle 20 comprises at least one secondary bore 22, extending along a secondary axis D2 parallel to the main axis D1 and separate therefrom, for receiving and guiding a guiding face 41 comprised in a control rod 4 manoeuvred by a control crown 10.

The invention further relates to a timepiece 1000 comprising such a case 100 and/or at least one such crown 10. More particularly, this timepiece 1000 is a watch.

Figure 8:
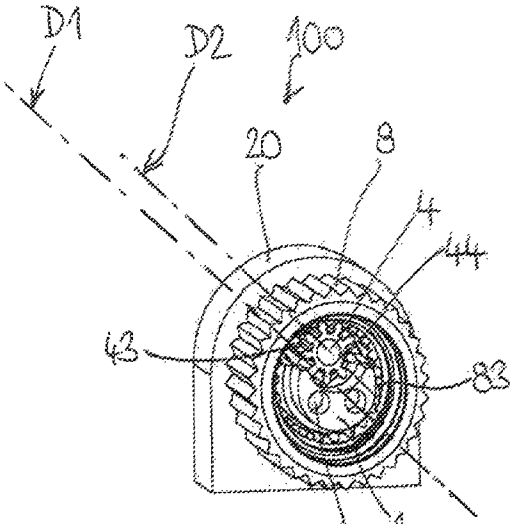
FIGS. 6 to 10 diagrammatically show perspective views of the successive steps for assembling the different components with one another.
Figure 10:
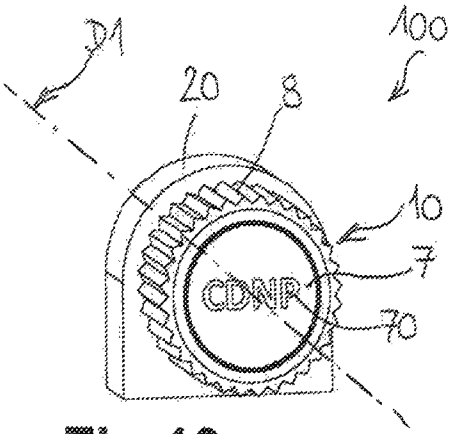
Figure 7:
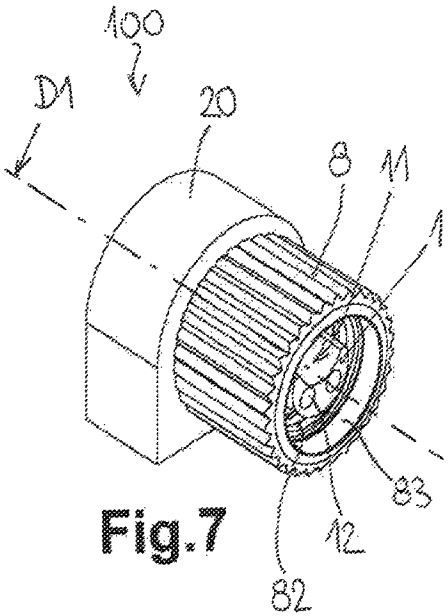
Figure 11:
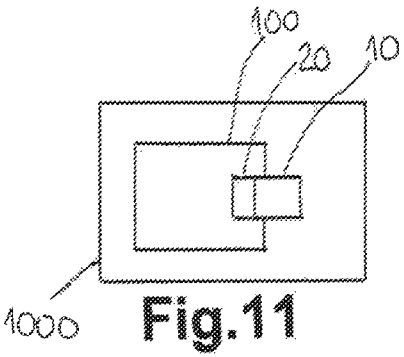
FIG. 11 is a block diagram showing a timepiece, in particular a watch, comprising a case with such a middle and such a control crown.
Figure 6:
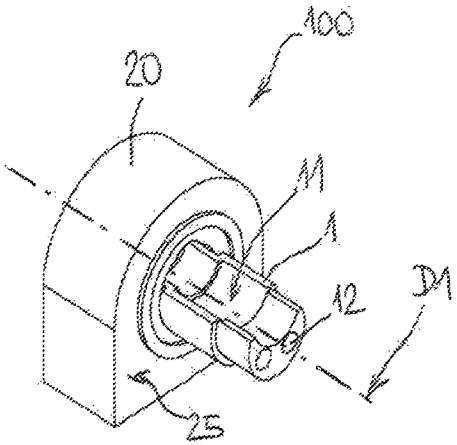
Figure 9:
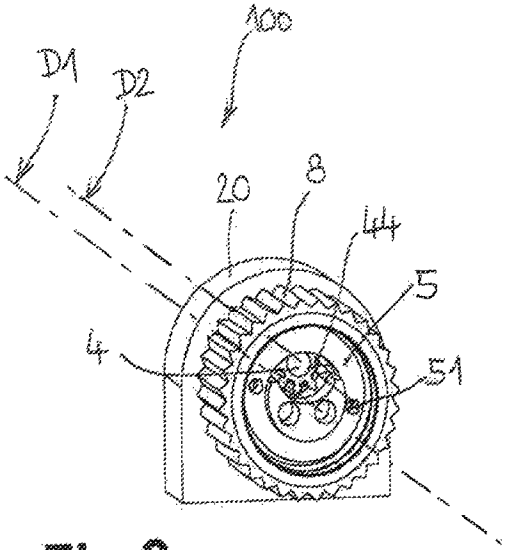

The invention allows a well-sealed control crown 10 comprising few components, to be obtained. FIGS. 6 to 10 show the extremely easy assembly thereof on the crown:

FIG. 6 shows the insertion and fastening, in particular by driving in, however not limited thereto, of the tube 1 inside the main recess 21 of the middle 2. Indexing means are shown on the tube 1, at the end thereof opposite the middle, formed by two bores 12 in this particular case; in alternative embodiments, the tube 1 can be bonded, welded, brazed or otherwise. It should be noted that, in the particular, non-limiting case of the figures, the main recess 21 is a blind bore: this results in communication between the inside of the case 100 comprising the middle 20, and the external environment in this area, being solely procured by the connection between the secondary bore 22 and the guiding face 41 of the control rod 4, which is easier to seal as a result of the small diameter thereof; in particular, the seal is procured by a rod gasket 3, housed inside a groove 45 made in the control rod 4, and which is compressed inside the secondary bore 22 of the middle 20;

FIG. 7 shows the insertion of the crown body 8, mounted such that it is free on the tube 1, and which can bear against a front face 25 of the middle 20. This figure shows the end of the tube 1 and, inside the crown body 8, the tapping 82 intended to receive the nut 5; the counterbore 83 intended to receive the closing cap 7 is also shown;

FIG. 8 shows the insertion of the control rod 4 between the crown body 8 and the tube 1, the tube 1 comprising, on the middle 20 side, a guiding face 41 shown in FIG. 1, which is inserted into the secondary bore 22, which is a through-bore, of the middle 20 also shown in FIG. 1. The control rod 4 then comprises an outer spline or respectively toothing 43, which meshes with the inner spline or toothing 81 of the crown body 8; a substantially planar bearing surface 44, perpendicular to the axis of the control rod 4 can be seen, on the side opposite the middle 20;

FIG. 9 shows the screwing of a nut 5 inside the tapping 82 of the crown body 8, this nut 5 allows the end of the tube opposite the middle to pass, however limits the axial travel of the control rod 4 contained therein; more particularly, this nut 5 can be bonded, or stopped by a laser welding spot, or other means;

FIG. 10 shows the fastening, by driving in, bonding or other method, of the closing cap 7 onto the tube 1, in an imposed angular position; more particularly, this cap 7 comprises lugs 71 which cooperate with the bores 12 of the tube 1.

In conclusion, the invention allows a closing cap 7 to be disposed in a fixed angular position relative to the middle 20, and which can bear a logo or similar element, without the risk of angular disorientation. The rotating components are well protected, and the impermeability can be assured by conventional means.

The possibility of off-centring the control rod 4 relative to the crown body 8 allows for the bespoke positioning thereof relative to the case 100. This can be of interest for the optimal positioning thereof along the height of the case, or even for a control that is offset relative to the most common positions.

The invention claimed is:

1. A control crown for a timepiece, capable of cooperating with a middle for maneuvering a control rod belonging to said control crown, said middle comprising at least one main recess along a main axis for receiving a tube comprised in said control crown, said control crown comprising:

a crown body capable of being mounted such that it rotates about said main axis and arranged so as to be handled by a user to maneuver said control rod, and said crown body covering both said tube and said control rod, wherein said tube comprises a hollow to allow said control rod to pass and/or be guided in rotation about an axis parallel to, but not coaxial with, said main axis, wherein said control crown comprises a closing cap arranged so as to be fastened to said tube, in a fixed angular position relative to said middle by the cooperation between indexing means comprised in said tube and complementary indexing means comprised in said closing cap, to axially enclose said crown body between said middle and said closing cap, wherein said hollow is off-centred to allow said control rod to pass and/or be guided in rotation about a secondary axis parallel to said main axis and separate therefrom.

2. The control crown according to claim 1, wherein said crown body comprises a counterbore within the crown body, and wherein a gasket is positioned between said counterbore and said closing cap.

3. The control crown according to claim 1, wherein said crown body comprises an inner toothing or spline, arranged so as to cooperate with an outer toothing or respectively spline comprised in said control rod, to drive said control rod in rotation.

4. The control crown according to claim 1, wherein said crown body comprises a tapping capable of cooperating in a complementary manner with a threading of a nut comprised in a frontal bearing surface arranged so as to form an abutment axial to a complementary frontal bearing surface comprised in said control rod, on the side opposite said middle.

5. The control crown according to claim 1, wherein said crown body is capable of moving between said middle and said closing cap with limited axial travel, and wherein said crown body comprises a flange constituting a means for axially stopping said control rod on said middle side.

6. The control crown according to claim 5, wherein said crown body is returned towards said middle by an elastic return means biased to press same against said middle.

7. The control crown according to claim 3, wherein said crown body is capable of moving between said middle and said closing cap with limited axial travel, and wherein said crown body comprises a flange constituting a means for axially stopping said control rod on said middle side, and wherein said inner toothing or spline comprised in said crown body, and arranged so as to drive said control rod in rotation, is only engaged with said control rod over a part of said axial travel.

8. A timepiece case, comprising:

the control crown according to claim 1, and the middle for maneuvering the control rod belonging to said control crown, wherein said tube of the control crown is inserted into said at least one main recess of the middle.

9. The case according to claim 8, wherein said middle comprises at least one secondary bore, extending along said secondary axis parallel to said main axis and separate therefrom, for receiving and guiding a guiding face comprised in said control rod maneuvered by said control crown.

10. The timepiece comprising the case according to claim 8.

11. The timepiece according to claim 10, wherein said timepiece is a watch.

* * * * *